United States Patent [19]

Nomura et al.

[11] 4,234,945

[45] Nov. 18, 1980

[54] ELECTRONIC TIMEPIECE WITH HOURLY STRIKE MECHANISM

[75] Inventors: Yasushi Nomura; Yuzo Komatsu, both of Tokorozawa; Shigeru Morokawa, Higashiyamato, all of Japan

[73] Assignees: Citizen Watch Co., Ltd.; Rhythm Watch Co., Ltd., both of Tokyo, Japan

[21] Appl. No.: 883,897

[22] Filed: Mar. 6, 1978

[30] Foreign Application Priority Data

Mar. 7, 1977 [JP] Japan ..... 52/23883

[51] Int. Cl.[3] ..... G04B 21/00; G04B 21/02; G08B 3/00

[52] U.S. Cl. ..... 368/75; 368/272; 340/384 E

[58] Field of Search ..... 58/12–14, 58/16 R, 19 R, 21.12, 38 R, 38 A, 39, 152 R, 152 B; 340/384 R, 384 E, 392

[56] References Cited

U.S. PATENT DOCUMENTS

| | | | |
|---|---|---|---|
| 4,055,843 | 10/1977 | Whitaker | 340/384 E |
| 4,073,133 | 2/1978 | Earls et al. | 58/13 |
| 4,090,349 | 5/1978 | Takase | 58/12 |
| 4,098,071 | 1/1978 | Kawakami et al. | 58/39 |

*Primary Examiner*—Vit W. Miska
*Attorney, Agent, or Firm*—Sherman & Shalloway

[57] ABSTRACT

An electronic timepiece having an acoustic hour information function in which a photosensitive switch mechanism essentially comprising a photosensitive element is provided to detect a quantity of light below a predetermined value in the surrounding environment where the timepiece is placed and control the acoustic hour information function of the timepiece depending upon the detected result.

7 Claims, 10 Drawing Figures

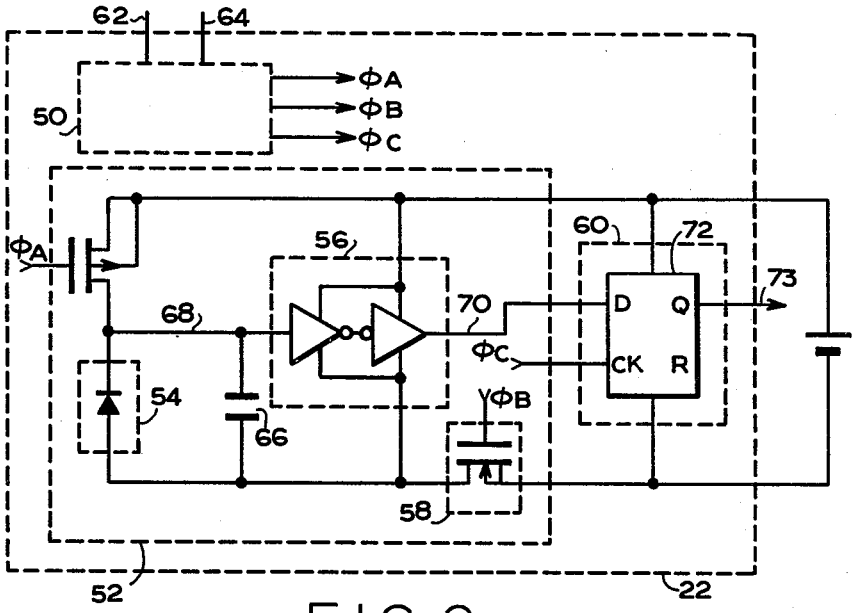
FIG. 2
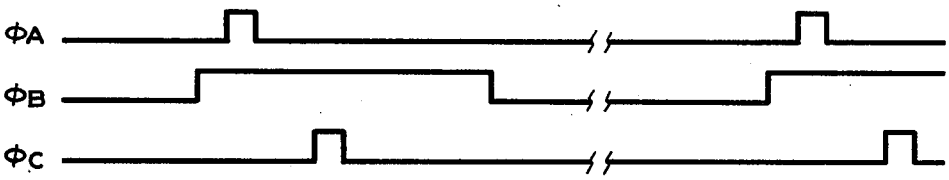
FIG. 3
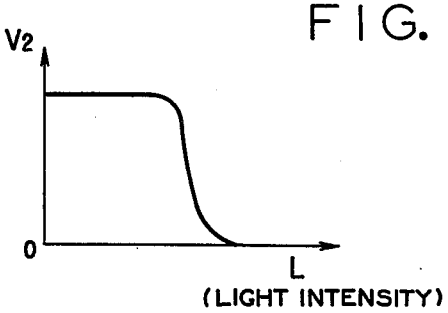
FIG. 4
FIG. 8
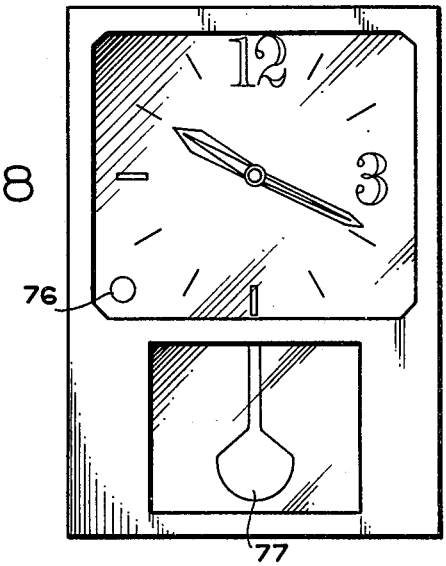

ELECTRONIC TIMEPIECE WITH HOURLY STRIKE MECHANISM

BACKGROUND OF THE INVENTION

This invention relates to an electronic timepiece having an acoustic hour information function.

There have been proposed and practically employed a great number of electronic timepieces having an acoustic hour information function. However, any of the conventional electronic timepieces having an acoustic hour information function has the disadvantage that the timepiece unnecessarily gives acoustic hour informations even at midnight times resulting in waking a sleeping person or persons up. The giving of acoustic hour informations at midnight times disturbes the sleeping person or persons.

It is troublesome to set the acoustic hour information producing mechanism in the inoperative position when such information is not required and then release the mechanism for operation so that an acoustic hour information or informations can be produced at times when the informations are required.

SUMMARY OF THE INVENTION

Therefore, the purpose of the present invention is to provide an electronic timepiece having an acoustic hour information function which can effectively eliminate the drawbacks inherent in the conventional electronic timepieces as referred to hereinabove.

According to the present invention, the purpose can be attained by providing an electronic timepiece having an acoustic hour information function in which a photosensitive switch mechanism comprising a photosensitive element detects a quantity of light below a predetermined value in the surrounding environment where the timepiece is placed and controls the acoustic hour information function of the timepiece based on the detected value whereby the acoustic hour information function is stopped at midnight times when the surrounding environment is dark and such information or informations are usually not required and resumed at early times in the morning when the surrounding environment is light and the acoustic hour information or informations are required.

The above and other objects and attendant advantages of the present invention will be more readily apparent to those skilled in the art from a reading of the following detailed description in conjunction with the accompanying drawings which show several preferred embodiments of the invention for illustration purpose only, but not for limiting the scope of the same in any way.

BRIEF DESCRIPTION OF THE DRAWINGS

FIG. 2 is a diagram of one embodiment of circuit of the photosensitive switch mechanism as shown in FIG. 1;

FIG. 3 is a view showing operation wave forms of pulses $\phi A$, $\phi B$ and $\phi C$ as shown in FIG. 2;

FIG. 4 is an explanative view of FIG. 2 showing the relationship between voltage $L_2$ and light intensity;

FIG. 8 is a front elevational view of the electronic timepiece incorporating the circuit as shown in FIG. 6 or 7 therein.

PREFERRED EMBODIMENT OF THE INVENTION

Figure 1:
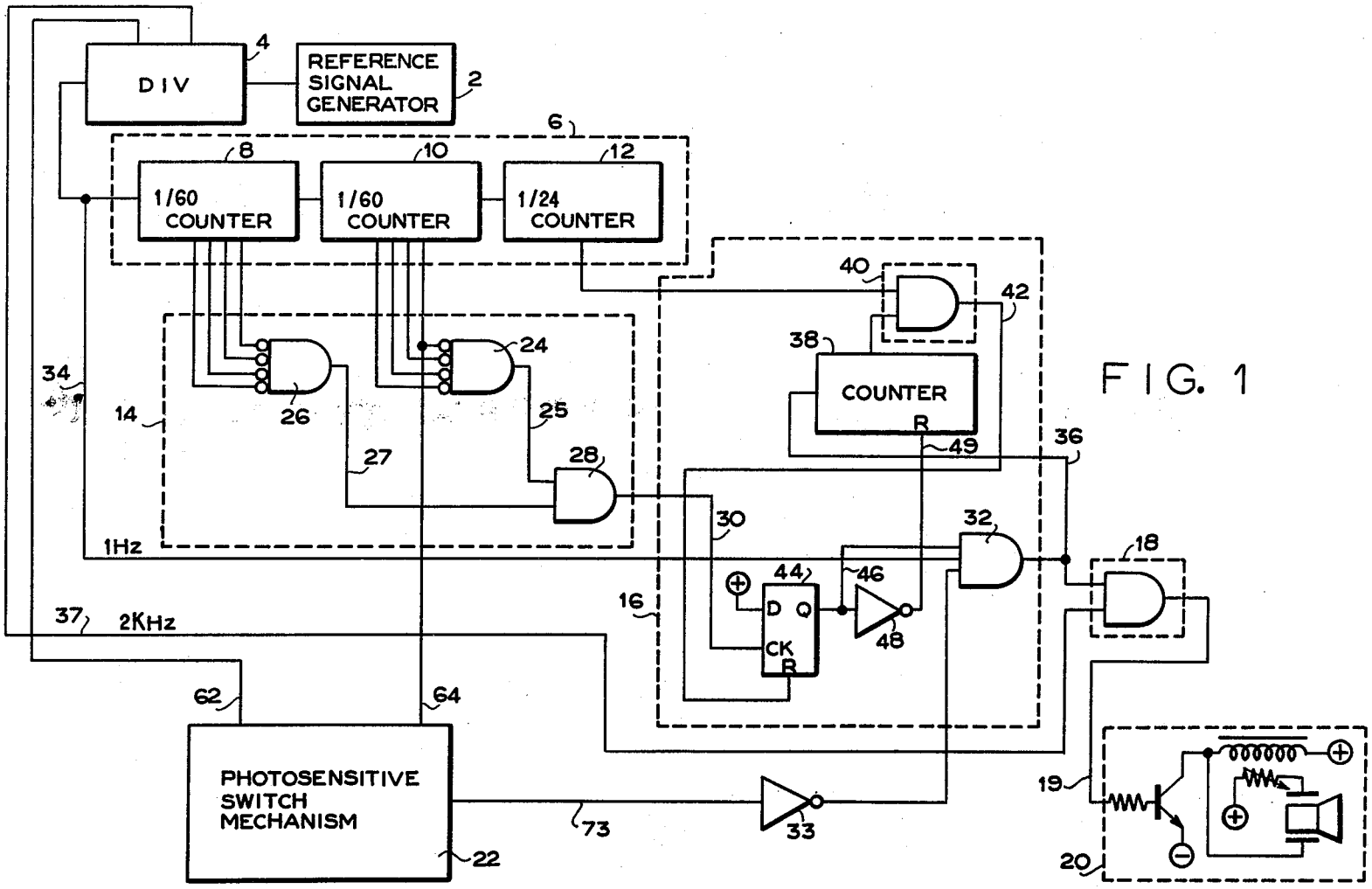
FIG. 1 is a fragmentary diagram of the circuit of one embodiment of the electronic timepiece having an acoustic hour information function constructed in accordance with the present invention.

The present invention will be now described referring to the accompanying drawings and more particularly, to FIG. 1 thereof in which the circuit of one embodiment of the electronic timepiece having an acoustic hour information function of the invention is fragmentarily shown. In this Figure, 2 denotes a time reference signal generator, 4 denotes a frequency division circuit, 6 denotes a time keep counter circuit, 8 denotes a second counter, 10 denotes a minute counter, 12 denotes a hour counter, 14 denotes an hour information time detection circuit, 16 denotes an acoustic hour information control circuit, 18 denotes an information sound control circuit, 20 denotes an acoustic hour information alarm mechanism and 22 denotes a photosensitive switch mechanism. When the minute counter 10 and second counter 8 in the time counter circuit 16 give the indication of zero, respectively, the output lines 25, 27 of the gates 24, 26 associated with the minute counter 10 and second counter 8, respectively turn to H (high) level and the output line 30 of the AND gate 28 also turns to H level.

As the line 30 turns from L (low) level to H (high) level, the Q output line 46 of the flip-flop 44 also turns from L level to H level and the H level of the Q output line 46 is stored and set to thereby open the AND gate 32. When the AND gate 32 is opened, 1 Hz signal transmitted from the frequency division circuit 4 to the AND gate 32 through the line 34 is output to the output line 36 of the AND gate 32 to thereby vary the count value on the counter 38. When the count value on the counter 38 coincides with the count value on the hour counter 12, the coincidence is detected by the coincidence detection circuit 40 and the output line 42 from the circuit 40 turns from L level to H level. Simultaneously, the flip-flop 44 is reset and the output line 46 from the flip-flop turns from H level to L level and the line is set at L level to thereby close the AND gate 32. Simultaneously, the line 49 turns to H level through the inverter 48 to reset the counter 38.

Meantime, 1 Hz signal trnsmitted to the line 36 is then transmitted to the information sound control circuit 18 and synthesized with 2 Hz signal transmitted from the frequency division circuit 4 through the line 37 to the circuit 18. The synthesized signal is transmitted through the line 19 to the acoustic hour information alarm mechanism 20 to give an hour information sound until the AND gate 32 closes.

For example, assuming that the holding time of the hour counter 12 is 3 o'clock, when 1 Hz signal by three pulse is output to the line 36, the counter 38 gives the indication "3" and coincides with the indication of the hour counter 12. Thus, the output line 40 of the coincidence detection circuit 40 turns to H level and the flip-flop 44 is reset to thereby close the AND gate 32. However, meantime, since 1 Hz signal by three pulses is being transmitted to the information sound control circuit 18, a loud sound hour information carrying 2 K Hz signal is given three times for one second. In other words, the acoustic hour information sound is given in the number of times corresponding to a particular holding time of the hour counter 12.

In the timepiece under consideration, the hour counter 12 is designed to count the number of hours from 1 o'clock to 12 o'clock and at 12 o'clock, the hour counter gives the hour information sound twelve times. Under normal conditions, the output line 73 from the photosensitive switch mechanism 22 is at L level and thus, the line 73 on which the inverter 33 is provided is at L level. However, when the line 73 turns to H level and the line 75 turns to L level, the AND gate 32 is closed and therefore, any hour information sound will not be produced even when the time to be informed has come.

FIG. 2 diagrammatically shows one embodiment of circuit of the photosensitive switch mechanism shown in FIG. 1 and in this Figure, 50 denotes a control pulse forming circuit, 52 denotes a light detection circuit, 54 denotes a photosensitive element, 56 denotes a wave form shaping circuit, 58 denotes an intermittent switch means and 60 denotes a memory.

Signals are transmitted from the frequency division circuit 4 and through the lines 62 and 64, respectively to the control pulse forming circuit 50 where signals $\phi A$, $\phi B$ and $\phi C$ are formed as shown in FIG. 3.

When $\phi B$ signal turns to H level, the compensating metal oxide semiconductor of the intermittent switch means 58 operates to supply power to the light detection circuit 52 to energize the circuit. When $\phi A$ signal turns to H level, the capacitor 66 is charged. Assuming that the voltage on the line 68 is $V_1$ and the voltage on the line 70 is $V_2$ respectively, the value of the $V_2$ varies as shown in FIG. 4 as time elapses by the time space T between signal $\phi A$ and $\phi C$. More particularly, the higher the intensity of the light is, the smaller the value of $V_2$ is and vice versa. When signal $\phi C$ turns to H level, the level of $V_2$ on the line 70 is read by the flip-flop 72 of the memory 60. When the light has a predetermined low intensity, the Q output of the flip-flop 72 turns to H level and the line 73 turns to H level to thereby close the AND gate 32 whereupon the acoustic hour information function is terminated.

In the illustrated embodiment of timepiece, the photosensitive switch mechanism 22 controls the acoustic hour information giving mechanism in such a manner that when the light intensity is low, the acoustic hour information function automatically ceases and when the light intensity is high, the acoustic hour information function resumes.

And according to the present invention, the problem relating to power consumption is taken into consideration and in order to solve this problem, the light detection circuit 52 is energized intermittently at a predetermined time interval to thereby reduce power consumption by the light detection circuit 52, and the light information detected by the light detection circuit 52 is stored in the memory 60.

Figures 5, 7:
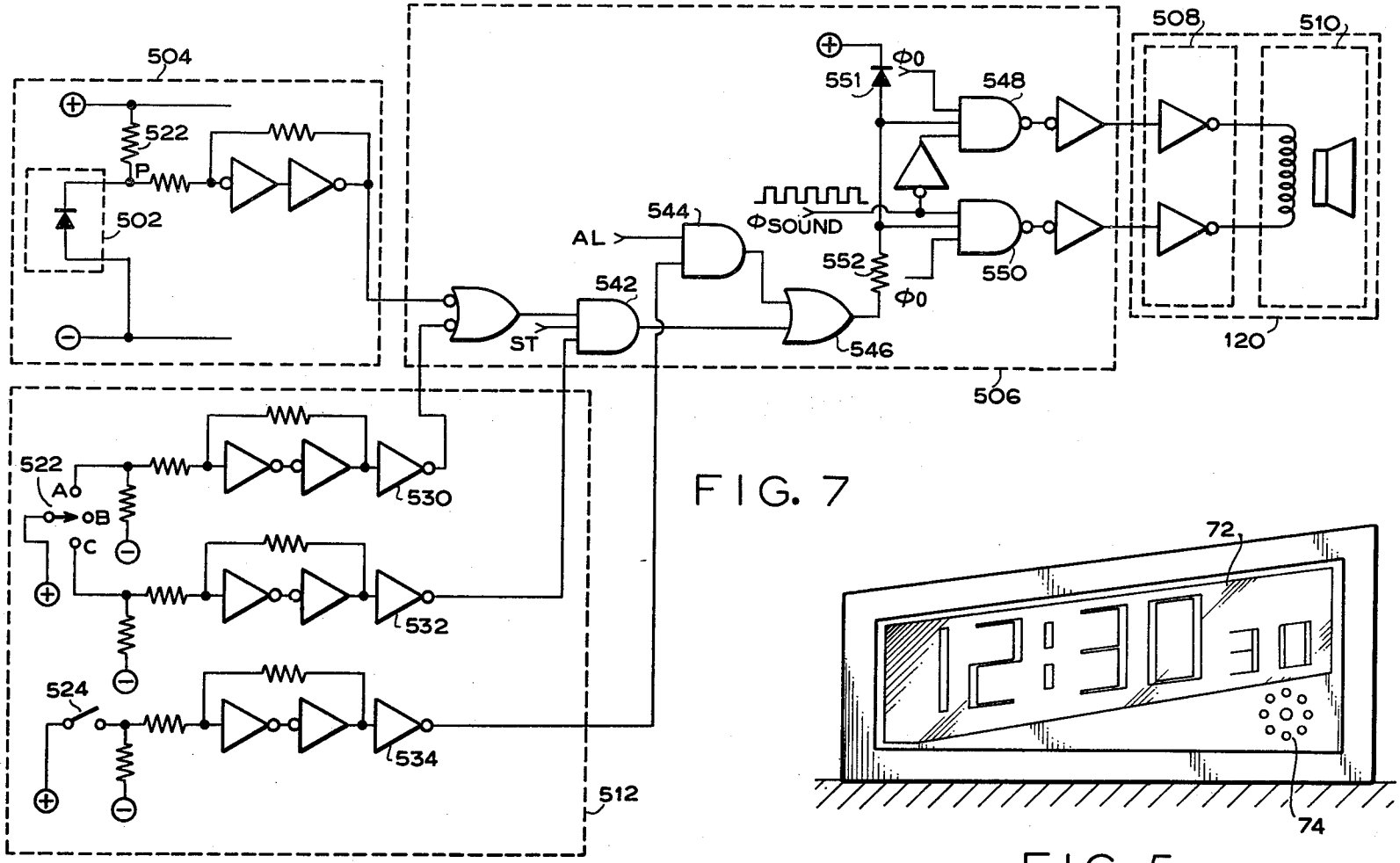
FIG. 5 is a front elevational view of said embodiment of electronic timepiece of the invention as shown in FIG. 1.
FIGS. 6 and 7 are fragmentary diagrams of modifications of said circuit as shown in FIG. 1.

FIG. 5 shows another embodiment of electronic timepiece having an acoustic hour information function of the invention in front elevation and the timepiece is shown as a liquid crystal display-type electronic timepiece. In FIG. 5, 72 denotes a time display and 74 denotes an hour information sound generator. The above-mentioned photosensitive element is mounted on the front case of the timepiece (not shown) to detect the light prevailing in the room where the timepiece is placed.

The quantity of light prevailing in the room exceeds a predetermined level, the hour information sound generator 74 gives a predetermined number of hour information at a correct or predetermined time. However, when the quantity of light is below a predetermined level, the hour information sound generation by the generator 74 is inhibited.

Figure 6:
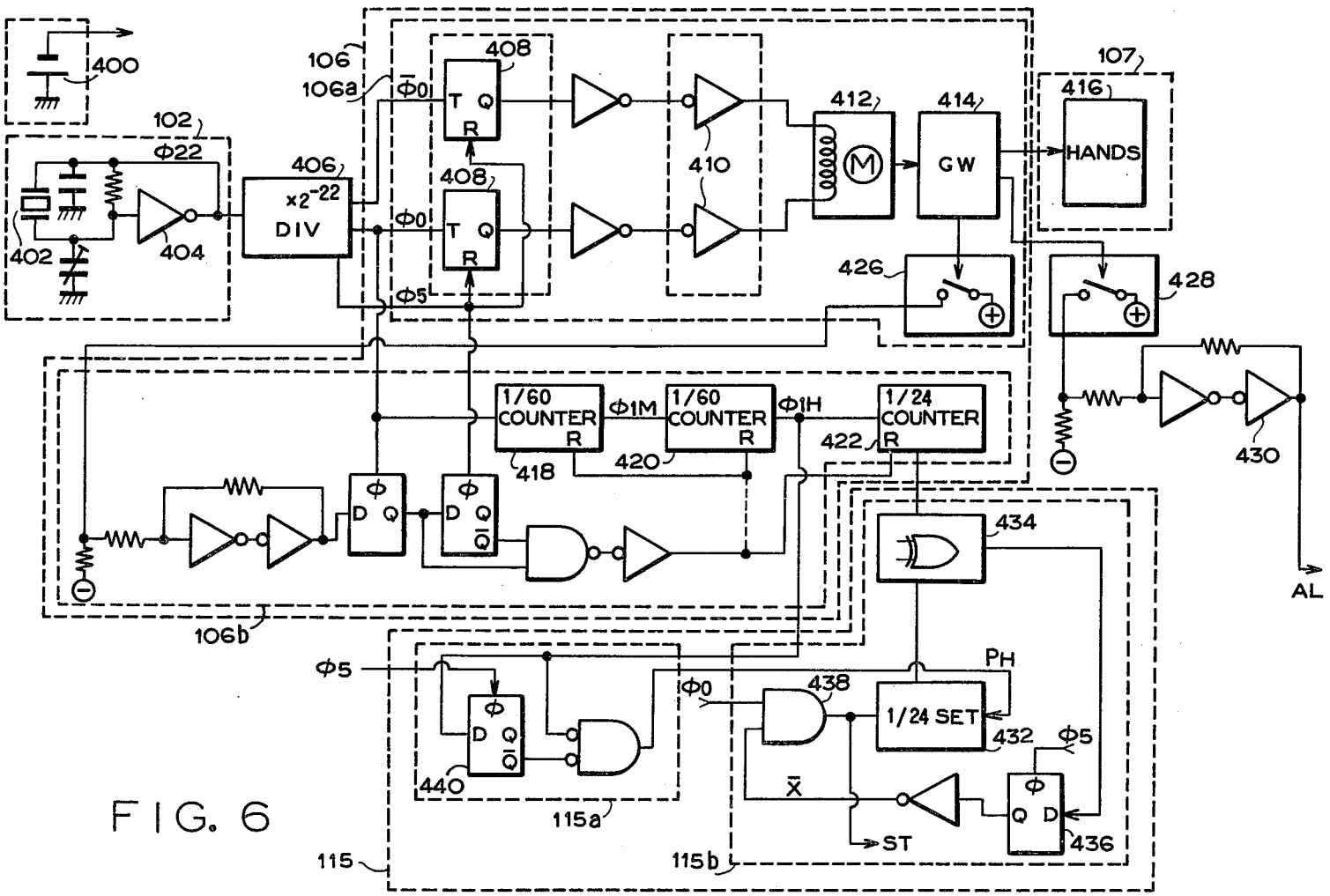

FIGS. 6 and 7 show the time keep, alarm and acoustic hour information generation sections of another embodiment of timepiece according to the present invention.

In FIG. 6, reference numeral 102 depicts a reference signal generator connected with a time keep mechanism 106 composed of a mechanical time keep means **106*a* and an electrical time keep means 106*b* for synthesizing time unit and count signals from a time reference signal. The mechanical time keep means 106*a* drives hands as a display device 107. Reference numeral 115 denotes an hour information control mechanism composed of an hour information detecting means 115*a* and an hour information control means 115*b***.

Describing FIG. 6 in greater detail, the suffix n of signal $\phi n$ (n=0–22) indicates that the signal is 2 n Hz signal. 400 denotes a cell, 402 denotes a crystal oscillation element of $2^{22}$ Hz, 406 denotes a frequency division circuit adapted to divide frequency within the range of $2^{22}$ to $2^{\circ}$ Hz, 408 denotes a motor drive wave form forming circuit, 410 denotes a motor drive power amplifier circuit, 412 denotes a motor, 414 denotes a wheel train connected to the motor and having a time keep counting function to mechanically keep time, 416 denotes a time indication hand, 418 denotes an electronic second count circuit, 420 denotes an electronic minute count circuit, 422 denotes an electronic hour count circuit, 426 denotes a sensor adapted to synchronize between an electric count circuit and a mechanical count circuit and the sensor is constituted by an electric switch connected to the wheel train 414, for example. 424 denotes an input circuit having noise removal and differentiation function. 428 denotes an alarm sensor constituted by a switch attached to an alarm index plate which is in turn connected to the wheel train 414, for example. 432 denotes an acoustic hour information count circuit and is of duodecimal or trisoctabedron system. The switch 432 is driven with 1 Hz signal of $\phi_o$ at a correct time in order to generate chaim sounds in the number corresponding to that of time informations. 440 denotes a differentiation circuit adapted to generate a thin pulse of $P_h$ in synchronism with the trailing edge of a carrying signal at a correct time. 434 denotes a coincidence detection circuit constituted by five exclusive OR circuits and a NOR circuit having the five outputs of the exclusive OR circuits as the input. The two input terminals of each of the five exclusive OR circuits are connected to the respectively corresponding five output terminals of each of the count circuits 422, 432 of binary system of five bits. 438 denotes a gate circuit. At a correct time or 5 o'clock, for example, a correct minute signal of $P_h$ resets the count circuit 432 to "0" and the count value of the count circuit 422 is inconsistent with that of the count circuit 432 whereby $\bar{x}$ becomes H level and the count circuit 432 is driven with five pulses of 1 Hz signal such as $S_t$ formed from $\phi_o$ through the gate circuit 438 until the count value becomes "5." When the count circuits 432 and 422 count the count value "5," the gate 438 closes. Even when $P_h$ is mechanically formed by the switch connected to the wheel train 414 at each 0 minute other than by $\phi$lh, the $P_h$ can drive the count circuit 432 utterly in the same manner as mentioned hereinabove.

In FIG. 7, 502 denotes a light detection sensor which can be a photoconductor fomed from semiconductor such as Cds (cadmium sulfide), PbS, ZnS, Si or Ge or a light-actuated element such as a photodiode or phototransistor, for example. In FIG. 5, a commercially available general purpose gas-sealed silicone diode is employed in inverted bias in order to attain cost reduction. 522 denotes a high resistor on the order of 100 M ohms which can be formed by a MDS resistor. 504 denotes a light detector for detecting the quantity of light in the surrounding environment where the timepiece is placed. 506 denotes a display modulator which controls the hour information sound depending upon the quantity of light in this embodiment. 508 denotes a sound generator drive circuit which is constituted by a C/MOS inverter of large Gm, for example, 510 denotes a sound element which can be materialized by a piezoelectric buzzer, electro-dynamic buzzer or variable reluctance type buzzer, for example. 512 denotes a sound control input and 522 denotes an hour information switch, 524 denotes an alarm switch. When the hour switch 522 is in the position A, an hour information sound is generated at a correct time regardless of the quantity of light in the surrounding environment, in the position B of the hour information switch 522, when the surrounding environment is light, that is, where the timepiece is placed in a living room, an hour information sound is generated when a resident or residents are astir, the hour information is generated and in the position C of the hour switch 522, the generation of any hour information is inhibited regardless of the quantity of light in the environment. The use of the timepiece of the invention can optionally control the hour information function. 524 denotes a switch adapted to direct inhibition of the hour information function and the switch can be set perfectly independent of the hour information generation. By the combination of the display modulator 506 and sound control input 512, only the hour information sound generation is inhibited while the alarm is allowed to generate sound.

When a light of high intensity strikes on the timepiece, the diode 502 allows leak current of several nanoamperes to flow through the diode in spite of bias in the inverted direction and the potential at Point P becomes L level. In a dark environment, the diode 502 is at a high resistance over 100 M ohms and the potential becomes H level at Point P. 548, 550, 542, 544 and 546 denote gate circuits. When Point P is at L level and the terminal A of the switch 522 is at L level, the hour information signal ST passes through the gate 542 to combine with an alarm signal at the gate 546. At the gates 548 and 550, a sound signal $\phi_{sound}$ of 2048 Hz, for example, and a modulation signal $\phi_o$ of 1 Hz, for example, form a sound signal having the inverse phase with respect to that of the signal $\phi_{sound}$ to thereby energize the buzzer 510 through the amplifier circuit 508. The alarm signal AL passes through the gate 544 to be applied to the gate 546. When the terminal D to which the switch 524 is to be connected is at H level, the alarm signal AL is inhibited at the gate 544 whereby the hour information sound generation is inhibited. When the terminal C to which the switch 522 is to be connected is at H level, the hour information signal ST is inhibited at the gate 542 in the first priority order whereby the hour information sound generation is inhibited and when the terminal A to which the switch 522 is to be connected at H level, the hour information signal ST can pass through the gate 542 so long as the terminal C is at L level regardless whether the diode 502 is in a light or dark environment and the hour information generator produces a positive hour information sound independent of the light in the environment.

551 denotes a diode which is less expensive like the diode 502 and shielded, painted, placed in a can or moulded in plastic so as not to be struck by light. 522 denotes a high resistor on the order of 100 M ohms and the resistor opens the gate 548 independent of the alarm signal AL and hour information signal ST when the environmental temperature of the timepiece increases abnormally. The resistor 522 functions to wake a sleeping person or persons up in case of fire, for example.

FIG. 8 shows a further modified embodiment of electronic timepiece in front elevation and the timepiece is shown as an analogue hand-type display electronic timepiece.

In this Figure, 76 denotes a photosensitive element, 77 denotes a pendulum which is designed to electromagnetically swing to alarm the time a predetermined number of times in giving an hour information sound. When the photosensitive element 76 detects a quantity of light below a predetermined value, the hour information sound generation function of the pendulum is ceased.

As clear from the foregoing description on the electronic timepiece of the invention, since the acoustic hour information function mechanism can be automatically controlled depending upon the quantity of light in the surrounding environment, the timepiece has the advantage that any acoustic hour information will not be produced when not required.

And the photosensitive switch which controls the acoustic hour information function mechanism comprises the intermittent switch means and memory which are designed to reduce power consumption and thus, the photosensitive switch mechanism can be equally utilized in a timepiece which employs a cell as the power source of the timepiece.

And in forming the control pulses as shown in FIG. 2 in order to reduce power consumption, the pulses are formed by synthesizing the signals from the hour counter 12 so that the intermitting pulses can be output only in a particular time zone of one day.

And in any of the embodiments of the present invention described hereinabove, it has been described that when the quantity of light in the surrounding environment has reduced to a value below a predetermined quantity of light, the hour information sound generation function is terminated, but the information sound may be also controlled depending upon the quantity of light.

In such a case, the two systems may be considered, that is, the system in which the acoustic hour information sound generation mechanism is controlled by detecting the quantity of light in the surrounding environment and varying the level on the line 73 based on the detected light quantity as described referring to FIG. 2 hereinabove and the system in which variation in the resistance value in the photosensitive element caused by variation in ,the quantity of light in the surrounding environment directly controls the volume of sound.

Figure 9:
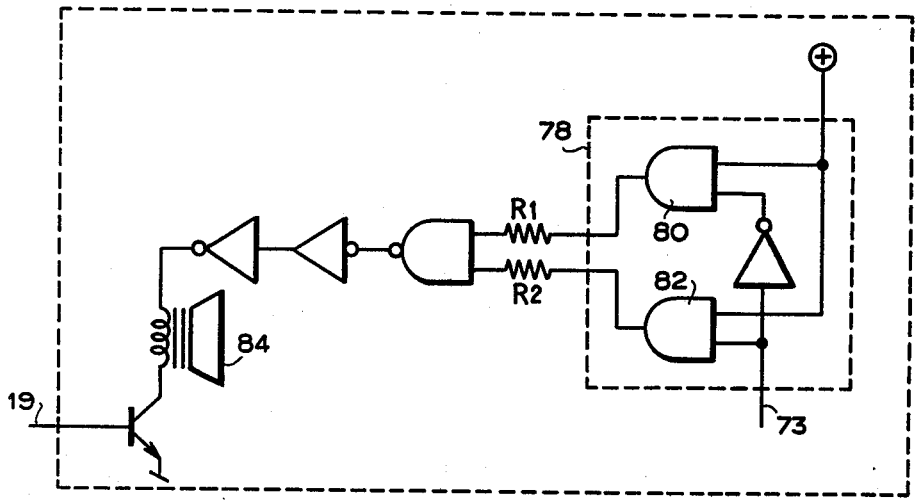
FIGS. 9 and 10 are diagrams of other embodiments of the circuit of the acoustic hour information mechanism of the invention.

FIG. 9 shows one embodiment of the acoustic hour information alarm mechanism 20 useful when the volume of sound is controlled and the mechanism is substantially based on the embodiment as shown in FIGS. 1 and 2. Variation in the volume of sound detected by the photosensitive switch mechanism 22 is employed for controlling the switching gate 78, but not the ADN gate 32 as described referring to FIG. 1 hereinabove.

The resistor $R_1$ and resistor $R_2$ have the relation such as $R_1 < R_2$ and thus, when the amount of light in the surrounding environment is great, the line 73 is at L level, the AND gate 80 of the switching gate 78 opens and high current flows through the resistors $R_1$ into the hour information sound generator 84 whereby a loud hour information sound is generated. On the other hand, when the amount of light in the surrounding environment is small, the line 73 is at H level, the AND gate 82 opens and small current flows through the resistor $R_2$ into the sound generator 84 whereby a low acoustic hour information sound is generated.

And as these resistors $R_1$ and $R_2$, circuits obtainable by the same processing procedure as employed in the production of MOS transistors such as ON resistors, P-WELL resistors and diffusion resistors for MOS transistors can be employed and such resistors can be made JC without requiring external attachment.

When these resistors are employed in conjunction with the sound control and termination mechanism as shown in FIG. 1, the acoustic hour information generation function can be terminated or the volume of sound of the acoustic hour information can be reduced depending upon the quantity of light in the surrounding environment.

Figure 10:
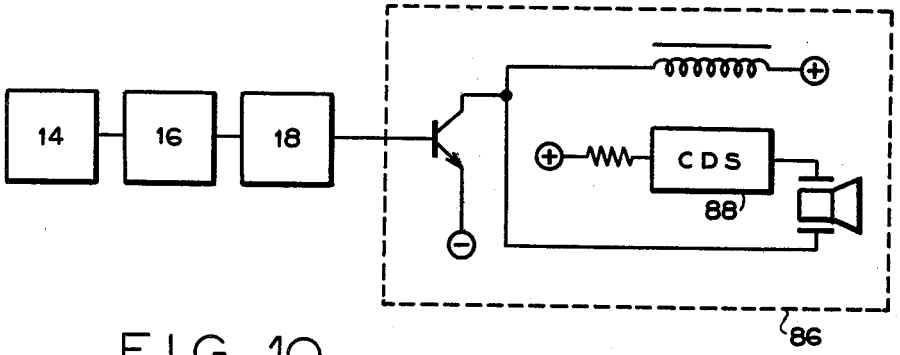

FIG. 10 shows one embodiment of the acoustic hour information alarm mechanism 86 useful when the volume of sound is directly controlled depending upon the quantity of light in the surrounding environment. In this embodiment, a CDS 88 is employed as the photosensitive element. When the quantity of light is great, the resistance of the CDS 88 decreases to allow high current to flow therethrough and on the other hand, when the quantity of light is small, the resistance of the CDS 88 increases to allow low current to flow therethrough whereby the volume of sound in the acoustic hour information can be controlled depending upon the quantity of light in the surrounding environment.

While several embodiments of the invention have been shown and described in detail, it will be understood that the same are for illustration purpose only and not to be taken as a definition of the invention, reference being had for this purpose to the appended claims.

What is claimed is:

1. An electronic timepiece comprising:

(a) a timepiece mechanism comprising a time reference signal generator, a frequency divider connected to said generator, a time keep mechanism connected to said divider, and a display device connected to said time keep mechanism;

(b) an acoustic information mechanism comprising an hour information time detection means receiving an output from said time keep mechanism, an acoustic hour information control means, and an alarm mechanism receiving an output of said acoustic hour information control means and emitting an alarm in response thereto; and (c) a photosensitive switch mechanism controlling said acoustic information mechanism, said photosensitive switch mechanism comprising an intermittent switch means and a memory means each connected to said timepiece mechanism, and a photosensitive element controlled intermittently by said intermittent switch means whereby the amount of light intermittently received by said photosensitive element is memorized by said memory means so that said acoustic information mechanism may be controlled in response to the memorized contents in said memory means.

2. An electronic timepiece as claimed in claim 1 wherein said photosensitive switch mechanism is connected to said acoustic hour information control means of said acoustic information mechanism and thereby controlling said acoustic hour information control means.

3. An electronic timepiece as claimed in claim 1 wherein said photosensitive switch mechanism is connected to said alarm mechanism and thereby controlling said alarm mechanism.

4. An electronic timepiece as claimed in claim 1 wherein a volume of said alarm mechanism is directly controlled by variations of resistance caused by variations of quantity of light.

5. An electronic timepiece as claimed in claim 1 wherein said electronic timepiece further comprises an input control circuit having a switch means for stopping the operation of said acoustic information mechanism.

6. An electronic timepiece as claimed in claim 1 wherein said electronic timepiece further comprises an input control circuit having a switch means inserted between said acoustic information mechanism and said photosensitive switch mechanism for stopping control of said photosensitive switch mechanism on said acoustic information mechanism.

7. An electronic timepiece as claimed in claim 1 wherein said alarm mechanism is also an acoustic hour information means for independently controlling the acoustic hour information.

* * * * *